US010782055B2

(12) United States Patent
Zha et al.

(10) Patent No.: US 10,782,055 B2
(45) Date of Patent: Sep. 22, 2020

(54) COOLING SYSTEM

(71) Applicant: Heatcraft Refrigeration Products LLC, Stone Mountain, GA (US)

(72) Inventors: Shitong Zha, Snellville, GA (US); Xi Sun, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 100 days.

(21) Appl. No.: 16/224,056

(22) Filed: Dec. 18, 2018

(65) Prior Publication Data

US 2020/0191457 A1 Jun. 18, 2020

(51) Int. Cl.

| | |
|---|---|
| ***F25B 47/02*** | (2006.01) |
| ***F25B 41/04*** | (2006.01) |
| ***F25B 1/10*** | (2006.01) |
| ***F25B 9/00*** | (2006.01) |

(52) U.S. Cl.

CPC ..... *F25B 47/02* (2013.01); *F25B 1/10* (2013.01); *F25B 9/008* (2013.01); *F25B 41/04* (2013.01); *F25B 2309/06* (2013.01); *F25B 2341/0013* (2013.01); *F25B 2400/19* (2013.01); *F25B 2400/23* (2013.01)

(58) Field of Classification Search

CPC .. F25B 47/02; F25B 41/04; F25B 1/10; F25B 9/008; F25B 2341/0013; F25B 2309/06; F25B 2400/23; F25B 2400/19

See application file for complete search history.

(56) References Cited

U.S. PATENT DOCUMENTS 2,155,484 A * 4/1939 Gottlieb ..... F24F 3/1405 62/163

FOREIGN PATENT DOCUMENTS

| | | |
|---|---|---|
| EP | 3023713 A1 | 5/2016 |
| EP | 3372919 A1 | 9/2018 |
| WO | 2013078088 A1 | 5/2013 |

OTHER PUBLICATIONS

European Patent Office, Extended European Search Report, Application No. 19210579.9, dated Apr. 21, 2020, 5 pages.

* cited by examiner

*Primary Examiner* — Ana M Vazquez
(74) *Attorney, Agent, or Firm* — Baker Botts L.L.P.

(57) ABSTRACT

An apparatus includes an ejector, a first load, a second load, a third load, a first compressor, a second compressor, and an accumulator. The ejector directs a refrigerant to a flash tank that stores the refrigerant. The loads use the refrigerant from the flash tank to cool spaces. The first compressor compresses the refrigerant from the first load. During a defrost cycle, the first compressor directs the refrigerant to the third load to defrost the third load, the accumulator separates the refrigerant that defrosted the third load into a second liquid portion and a second vapor portion, the ejector directs the second liquid portion to the flash tank, and the second compressor compresses the second vapor portion.

20 Claims, 4 Drawing Sheets

COOLING SYSTEM

TECHNICAL FIELD

This disclosure relates generally to a cooling system.

BACKGROUND

Cooling systems may cycle a refrigerant to cool various spaces. For example, a refrigeration system may cycle refrigerant to cool spaces near or around refrigeration loads. After the refrigerant absorbs heat, it can be cycled back to the refrigeration loads to defrost the refrigeration loads.

SUMMARY

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

In existing systems, one way to address frost and/or ice accumulation on the load is to cycle refrigerant back to the load after the refrigerant has absorbed heat from the load. Usually, discharge from a low temperature compressor is cycled back to a load to defrost that load. In this manner, the heated refrigerant passes over the frost and/or ice accumulation and defrosts the load. This process of cycling hot refrigerant over frosted and/or iced loads is known as hot gas defrost. Existing cooling systems that have a hot gas defrost cycle typically use a stepper valve at the low temperature compressor discharge to increase the pressure of the refrigerant so that the refrigerant can be directed to the flash tank after defrost. However, the pressure difference between the refrigerant at the low temperature compressor and the refrigerant in the flash tank can be small (e.g., 4 bar). As a result, large piping is typically used to limit the pressure drop of the refrigerant during defrost, which can be costly and increase the footprint of the system.

This disclosure contemplates a cooling system that performs hot gas defrost while maintaining a larger pressure differential (e.g., 12 bar). The system includes an accumulator that separates refrigerant into liquid and vapor components. After refrigerant is used to defrost a load, the refrigerant is directed to the accumulator. The accumulator separates this refrigerant into liquid and vapor components. The liquid component is directed to the flash tank through an ejector, and the vapor component is directed to a medium temperature compressor. Because the pressure of the refrigerant at the accumulator is lower than the pressure of the refrigerant at the flash tank, the pressure differential of the refrigerant between the low temperature compressor and the accumulator is increased. As a result, smaller piping may be used, which reduces cost and the footprint of the system. Certain embodiments of the cooling system are described below.

According to an embodiment, an apparatus includes an ejector, a first load, a second load, a third load, a first compressor, a second compressor, and an accumulator. The ejector directs a refrigerant to a flash tank that stores the refrigerant. The first load uses the refrigerant from the flash tank to cool a first space proximate the first load. The second load uses the refrigerant from the flash tank to cool a second space proximate the second load. The first compressor compresses the refrigerant from the first load. The accumulator separates the refrigerant from the second load into a first liquid portion and a first vapor portion and directs the first liquid portion to the ejector. The ejector directs the first liquid portion to the flash tank. The accumulator directs the first vapor portion to the second compressor. The second compressor compresses the first vapor portion. During a first mode of operation, the third load uses the refrigerant from the flash tank to cool a third space proximate the third load, the first compressor compresses the refrigerant from the third load, and the second compressor compresses the refrigerant from the first compressor. During a second mode of operation, the first compressor directs the refrigerant to the third load to defrost the third load, the accumulator separates the refrigerant that defrosted the third load into a second liquid portion and a second vapor portion, the ejector directs the second liquid portion to the flash tank, and the second compressor compresses the second vapor portion.

According to another embodiment, a method includes directing, by an ejector, a refrigerant to a flash tank and storing, by the flash tank, the refrigerant. The method also includes using, by a first load, the refrigerant from the flash tank to cool a first space proximate the first load and using, by a second load, the refrigerant from the flash tank to cool a second space proximate the second load. The method further includes compressing, by a first compressor, the refrigerant from the first load and separating, by an accumulator, the refrigerant from the second load into a first liquid portion and a first vapor portion. The method also includes directing, by the accumulator, the first liquid portion to the ejector, directing, by the ejector, the first liquid portion to the flash tank, directing, by the accumulator, the first vapor portion to a second compressor, and compressing, by the second compressor, the first vapor portion. During a first mode of operation, the method includes using, by a third load, the refrigerant from the flash tank to cool a third space proximate the third load, compressing, by the first compressor, the refrigerant from the third load, and compressing, by the second compressor, the refrigerant from the first compressor. During a second mode of operation, the method includes directing, by the first compressor, the refrigerant to the third load to defrost the third load, separating, by the accumulator, the refrigerant that defrosted the third load into a second liquid portion and a second vapor portion, directing, by the ejector, the second liquid portion to the flash tank, and compressing, by the second compressor, the second vapor portion.

According to yet another embodiment, a system includes a high side heat exchanger, an ejector, a first load, a second load, a third load, a first compressor, a second compressor, and an accumulator. The high side heat exchanger removes heat from a refrigerant. The ejector directs the refrigerant from the high side heat exchanger to a flash tank that stores the refrigerant. The first load uses the refrigerant from the flash tank to cool a first space proximate the first load. The second load uses the refrigerant from the flash tank to cool a second space proximate the second load. The first compressor compresses the refrigerant from the first load. The accumulator separates the refrigerant from the second load into a first liquid portion and a first vapor portion and directs the first liquid portion to the ejector. The ejector directs the first liquid portion to the flash tank. The accumulator directs the first vapor portion to the second compressor. The second compressor compresses the first vapor portion. During a first mode of operation, the third load uses the refrigerant from the flash tank to cool a third space proximate the third load, the first compressor compresses the refrigerant from the third load, and the second compressor compresses the refrigerant from the first compressor. During a second mode of operation, the first compressor directs the refrigerant to the third load to defrost the third load, the accumulator separates the refrigerant that defrosted the third load into a second liquid portion and a second vapor portion, the ejector directs the second liquid portion to the flash tank, and the second compressor compresses the second vapor portion.

Certain embodiments provide one or more technical advantages. For example, an embodiment reduces the size and cost of piping in a cooling system by directing refrigerant used to defrost a load to an accumulator, rather than directly to a flash tank. As another example, an embodiment reduces the amount of refrigerant in a cooling system and the size of a flash tank in the cooling system by directing refrigerant used to defrost a load to an accumulator, rather than directly to a flash tank. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

In existing systems, one way to address frost and/or ice accumulation on the load is to cycle refrigerant back to the load after the refrigerant has absorbed heat from the load. Usually, discharge from a low temperature compressor is cycled back to a load to defrost that load. In this manner, the heated refrigerant passes over the frost and/or ice accumulation and defrosts the load. This process of cycling hot refrigerant over frosted and/or iced loads is known as hot gas defrost. Existing cooling systems that have a hot gas defrost cycle typically use a stepper valve at the low temperature compressor discharge to increase the pressure of the refrigerant so that the refrigerant can be directed to the flash tank after defrost. However, the pressure difference between the refrigerant at the low temperature compressor and the refrigerant in the flash tank can be small (e.g., 4 bar). As a result, large piping is typically used to limit the pressure drop of the refrigerant during defrost, which can be costly and increase the footprint of the system.

This disclosure contemplates a cooling system that performs hot gas defrost while maintaining a larger pressure differential (e.g., 12 bar). The system includes an accumulator that separates refrigerant into liquid and vapor components. After refrigerant is used to defrost a load, the refrigerant is directed to the accumulator. The accumulator separates this refrigerant into liquid and vapor components. The liquid component is directed to the flash tank through an ejector, and the vapor component is directed to a medium temperature compressor. Because the pressure of the refrigerant at the accumulator is lower than the pressure of the refrigerant at the flash tank, the pressure differential of the refrigerant between the low temperature compressor and the accumulator is increased. As a result, smaller piping may be used, which reduces cost and the footprint of the system.

Figure 1:
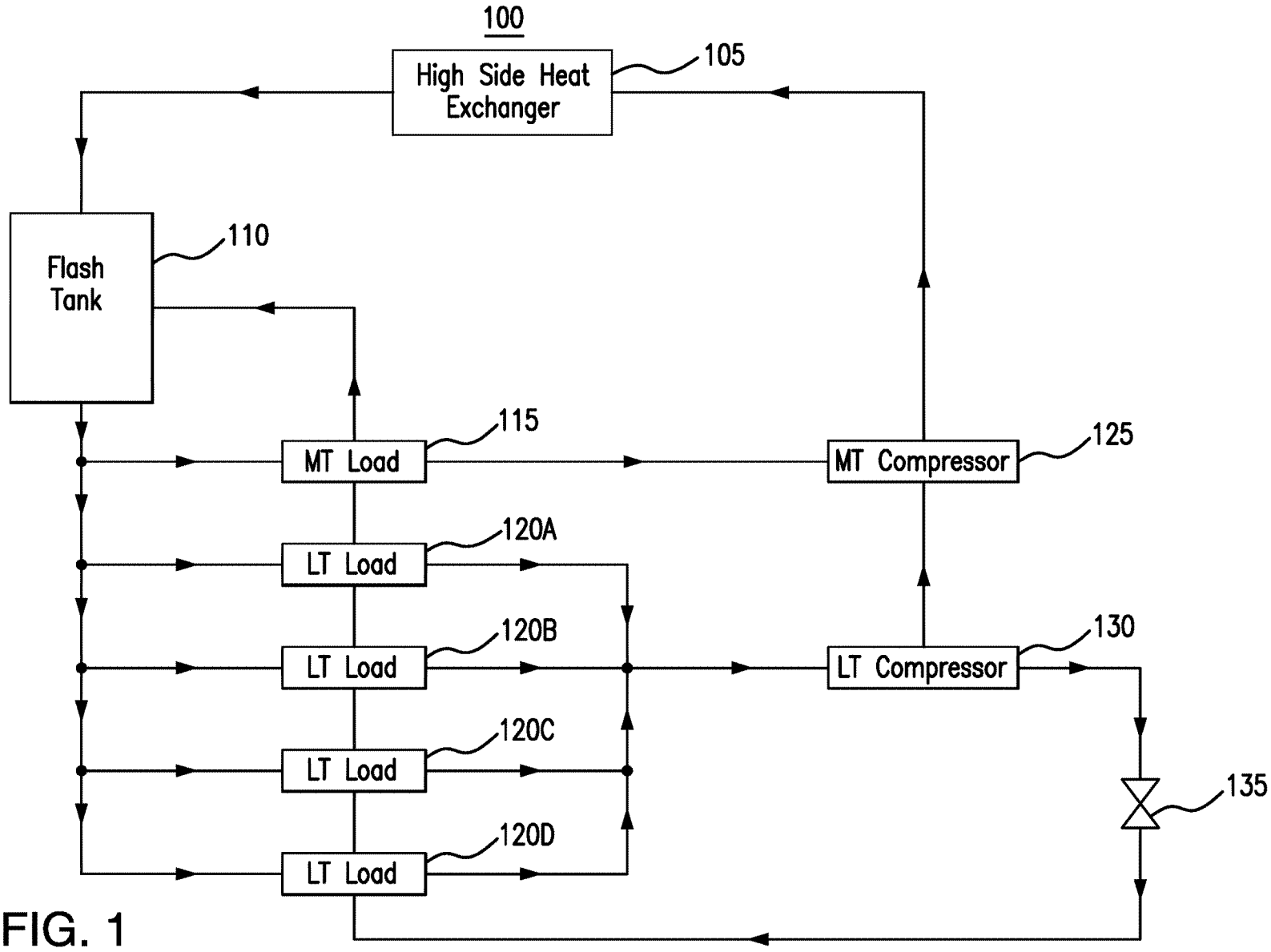
FIG. 1 illustrates an example cooling system.
Figure 2:
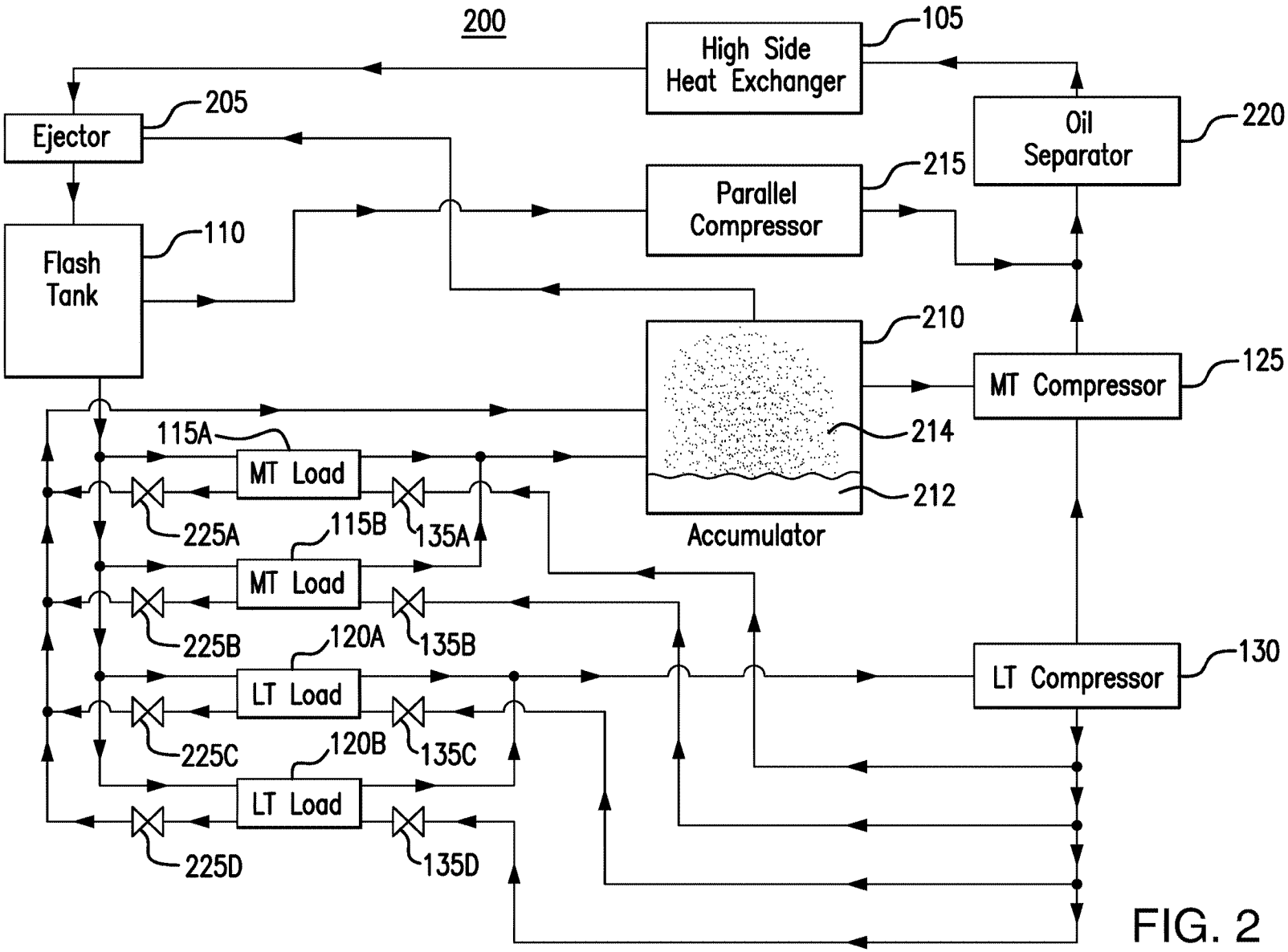
FIG. 2 illustrates an example cooling system.
Figure 3:
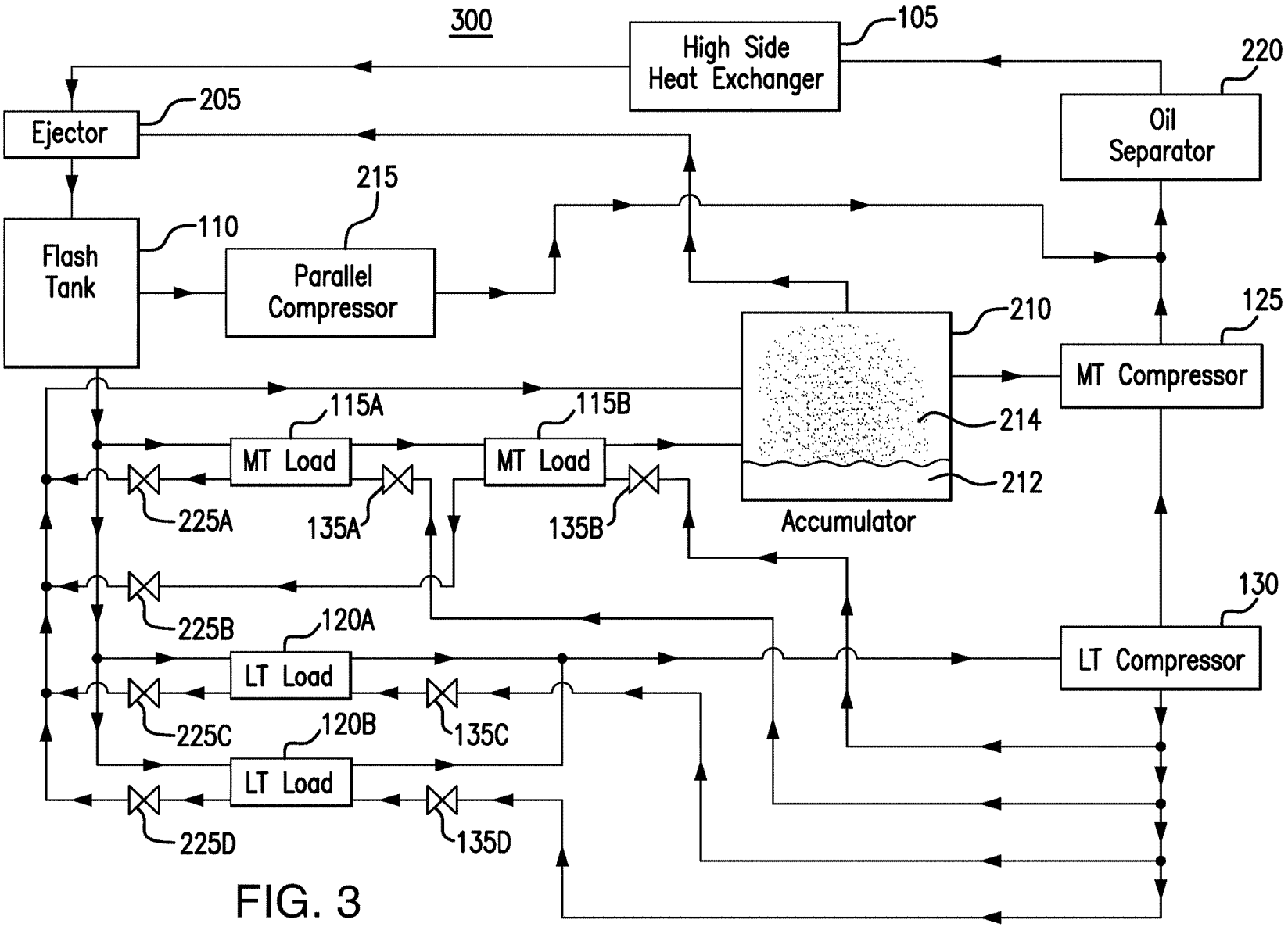
FIG. 3 illustrates an example cooling system.
Figure 4:
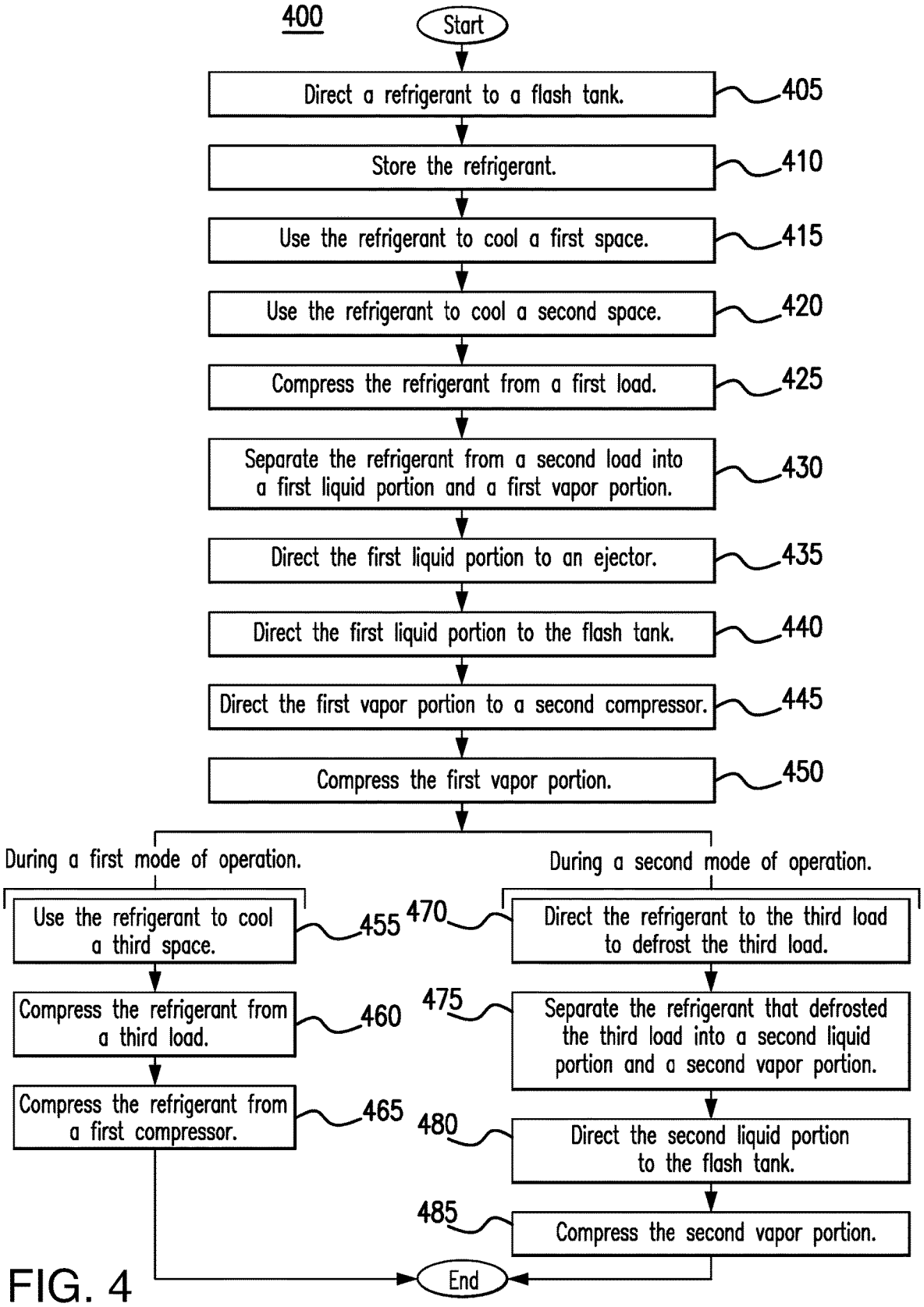
FIG. 4 is a flowchart illustrating a method of operating an example cooling system.

In certain embodiments, the size and cost of piping in a cooling system are reduced by directing refrigerant used to defrost a load to an accumulator, rather than directly to a flash tank. In some embodiments, the amount of refrigerant in a cooling system and the size of a flash tank in the cooling system are reduced by directing refrigerant used to defrost a load to an accumulator, rather than directly to a flash tank. The cooling system will be described using FIGS. 1 through 4. FIG. 1 will describe an existing cooling system with hot gas defrost. FIGS. 2 through 4 describe the cooling system with an accumulator and ejector.

FIG. 1 illustrates an example cooling system 100. As shown in FIG. 1, system 100 includes a high side heat exchanger 105, a flash tank 110, a medium temperature load 115, low temperature loads 120A-120D, a medium temperature compressor 125, a low temperature compressor 130, and a valve 135. By operating valve 135, system 100 allows for hot gas to be circulated to a low temperature load 120 to defrost low temperature load 120. After defrosting low temperature load 120, the hot gas and/or refrigerant is cycled back to flash tank 110. This disclosure contemplates cooling system 100 or any cooling system described herein including any number of loads, whether low temperature or medium temperature.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide) being used in any of the disclosed cooling systems.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature loads 120A-120D and medium temperature load 115. In some embodiments, a flash gas and/or a gaseous refrigerant is released from flash tank 110. By releasing flash gas, the pressure within flash tank 110 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 110 to both the low temperature and medium temperature portions of the refrigeration system. For example, the refrigerant flows to low temperature loads 120A-120D and medium temperature load 115. When the refrigerant reaches low temperature loads 120A-120D or medium temperature load 115, the refrigerant removes heat from the air around low temperature loads 120A-120D or medium temperature load 115. As a result, the air is cooled. The cooled air may then be circulated such as, for example, by a fan to cool a space such as, for example, a freezer and/or a refrigerated shelf. As refrigerant passes through low temperature loads 120A-120D and medium temperature load 115, the refrigerant may change from a liquid state to a gaseous state as it absorbs heat. This disclosure contemplates including any number of low temperature loads 120And medium temperature loads 115 in any of the disclosed cooling systems.

The refrigerant cools metallic components of low temperature loads 120A-120D and medium temperature load 115 as the refrigerant passes through low temperature loads 120A-120D and medium temperature load 115. For example, metallic coils, plates, parts of low temperature loads 120A-120D and medium temperature load 115 may cool as the refrigerant passes through them. These components may become so cold that vapor in the air external to these components condenses and eventually freeze or frost onto these components. As the ice or frost accumulates on these metallic components, it may become more difficult for the refrigerant in these components to absorb heat from the air external to these components. In essence, the frost and ice acts as a thermal barrier. As a result, the efficiency of cooling system 100 decreases the more ice and frost that accumulates. Cooling system 100 may use heated refrigerant to defrost these metallic components.

Refrigerant flows from low temperature loads 120A-D and medium temperature load 115 to compressors 125 and 130. This disclosure contemplates the disclosed cooling systems including any number of low temperature compressors 130 and medium temperature compressors 125. Both the low temperature compressor 130 and medium temperature compressor 125 compress refrigerant to increase the pressure of the refrigerant. As a result, the heat in the refrigerant may become concentrated and the refrigerant may become a high-pressure gas. Low temperature compressor 130 compresses refrigerant from low temperature loads 120A-120D and sends the compressed refrigerant to medium temperature compressor 125. Medium temperature compressor 125 compresses a mixture of the refrigerant from low temperature compressor 130 and medium temperature load 115. Medium temperature compressor 125 then sends the compressed refrigerant to high side heat exchanger 105.

Valve 135 may be opened or closed to cycle refrigerant from low temperature compressor 130 back to a low temperature load 120. The refrigerant may be heated after absorbing heat from the other low temperature loads 120 and being compressed by low temperature compressor 130. The hot refrigerant and/or hot gas is then cycled over the metallic components of the low temperature load 120 to defrost it. Afterwards, the hot gas and/or refrigerant is cycled back to flash tank 110. There may be additional valves between low temperature compressor 130 and low temperature loads 120A-D that control to which load 120A-D is defrosted by the refrigerant coming from low temperature compressor 130. This process of cycling heated refrigerant over a low temperature load 120 to defrost it is referred to as a defrost cycle.

Existing cooling systems that have a hot gas defrost cycle typically use a stepper valve at the low temperature compressor discharge to increase the pressure of the refrigerant so that the refrigerant can be directed to the flash tank after defrost. However, the pressure difference between the refrigerant at the low temperature compressor and the refrigerant in the flash tank can be small (e.g., 4 bar). As a result, large piping is typically used to limit the pressure drop of the refrigerant during defrost, which can be costly and increase the footprint of the system.

This disclosure contemplates a cooling system that performs hot gas defrost while maintaining a larger pressure differential (e.g., 12 bar). The system includes an accumulator that separates refrigerant into liquid and vapor components. After refrigerant is used to defrost a load, the refrigerant is directed to the accumulator. The accumulator separates this refrigerant into liquid and vapor components. The liquid component is directed to the flash tank through an ejector, and the vapor component is directed to a medium temperature compressor. Because the pressure of the refrigerant at the accumulator is lower than the pressure of the refrigerant at the flash tank, the pressure differential of the refrigerant between the low temperature compressor and the accumulator is increased. As a result, smaller piping may be used, which reduces cost and the footprint of the system. Embodiments of the cooling system are described below using FIGS. 2-4. These figures illustrate embodiments that include a certain number of loads and compressors for clarity and readability. However, this disclosure contemplates these embodiments including any suitable number of loads and compressors.

FIG. 2 illustrates an example cooling system 200. As seen in FIG. 2, cooling system 200 includes a high side heat exchanger 105, an ejector 205, a flash tank 110, medium temperature loads 115A and 115B, low temperature loads 120A and 120B, medium temperature compressor 125, low temperature compressor 130, valves 135A, 135B, 135C, and 135D, an accumulator 210, a parallel compressor 215, an oil separator 220, and valves 225A, 225B, 225C, and 225D. Generally, accumulator 210 separates a refrigerant used to defrost a load into liquid and vapor portions. Accumulator 210 then directs the liquid portion to ejector 205 in flash tank 110 and the vapor portion to medium temperature compressor 125. In this manner, the pressure differential between accumulator 210 and low temperature compressor 130 is increased relative to the pressure differential between low temperature compressor 130 and flash tank 110, which reduces the cost and size of piping used to contain the refrigerant in certain embodiments.

High side heat exchanger 105, flash tank 110, medium temperature loads 115A and 115B, low temperature loads 120A and 120B, and low temperature compressor 130 operate similarly in system 200 as they did in system 100. For example, high side heat exchanger 105 removes heat from a refrigerant. Flash tank 110 stores the refrigerant. Medium temperature loads 115A and 115B and low temperature loads 120A and 120B use the refrigerant from flash tank 110 to cool spaces proximate those loads. Low temperature compressor 130 compresses the refrigerant from low temperature loads 120A and 120B.

Ejector 205 receives refrigerant from high side heat exchanger 105 and/or accumulator 210. Ejector 205 then ejects and/or directs this refrigerant to flash tank 110. In some systems, the pressure of the ejected refrigerant is controlled and/or adjusted by the pressure of the refrigerant from accumulator 110 and the shape of ejector 205.

Accumulator 210 separates a received refrigerant into liquid and vapor portions. For examples, accumulator 210 receives the refrigerant from medium temperature loads 115A and 115B. Accumulator 210 then separates the received refrigerant into a liquid portion 212 and a vapor portion 214. Accumulator 210 then directs some of liquid portion 212 to ejector 205 and some of the vapor portion 214 to medium compressor 125. Ejector 205 directs liquid portion 212 to flash tank 110 for storage. Medium temperature compressor 125 compresses vapor portion 214. Some of liquid portion 212 and vapor portion 214 may remain in accumulator 210 instead of being directed to other components of system 200. During a defrost cycle, accumulator 210 receives refrigerant that was used to defrost a load. Accumulator 210 separates this refrigerant into liquid portion 212 and vapor portion 214. Some of liquid portion 212 is then directed to ejector 205 and flash tank 110, and some of vapor portion 214 is directed to medium temperature compressor 125.

Parallel compressor 215 compresses a flash gas from flash tank 110. Flash tank 110 may discharge the flash gas to parallel compressor 215. After parallel compressor 215 compresses the flash gas, parallel compressor 215 directs the compressed flash gas to oil separator 220. By discharging flash gas, the pressure of the refrigerant in flash tank 110 can be regulated.

Oil separator 220 separates an oil from received refrigerant. For example, oil separator 210 may receive refrigerant from parallel compressor 215 and/or medium temperature compressor 125. Oil separator 220 separates oil from this received refrigerant and directs the refrigerant to high side heat exchanger 105. By separating oil from the received refrigerant, oil separator 220 prevents the oil from flowing to other components of system 200. In this manner the oil does not damage other components of system 200.

During a first mode of operation (e.g., a regular refrigeration cycle), medium temperature loads 115A and 115B, and low temperature loads 120A and 120B use refrigerant from flash tank 110 to cool spaces proximate those loads. The refrigerant used by low temperature loads 120A and 120B is directed to low temperature compressor 130. The refrigerant used by medium temperature loads 115A and 115B is directly to accumulator 210. Low temperature compressor 130 compresses the refrigerant from low temperature load from 120A and 120B and directs the compressed refrigerant to medium temperature compressor 125. Accumulator 210 separates the refrigerant from medium temperature loads 115A and 115B into liquid portion 212 and vapor portion 214. Accumulator 210 then directs some of liquid portion 212 to ejector 205 and some of vapor portion 214 to medium temperature compressor 125. Medium temperature compressor 125 then compresses the refrigerant from low temperature compressor 130 and accumulator 210. After compressing the refrigerant, medium temperature compressor 125 directs the refrigerant to oil separator 220 and high side heat exchanger 105. In this manner, the refrigerant is cycled through system 200 to cool spaces proximate the loads.

During a defrost cycle, or a second mode of operation, one or more of the loads is defrosted using the refrigerant from low temperature compressor 130. Valves 135A, 135B, 135C, 135D, 225A, 225B, 225C, and/or 225D are controlled to allow refrigerant to flow from low temperature compressor 130 back to one of the loads to defrost the load. For example, in one defrost cycle, valves 135C and 225C can open to allow refrigerant to flow from low temperature compressor 130 through low temperature load 120A to defrost low temperature load 120A. In another defrost cycle, valve 135B and 225B can open to allow refrigerant to flow from low temperature compressor 130 through medium temperature load 115B to defrost medium temperature load 115B. This disclosure contemplates using refrigerant from low temperature compressor 130 to defrost any number of loads and any type of loads.

This disclosure contemplates valves 135A, 135B, 135C, 135D, 225A, 225B, 225C, and 225D being any type of valve. For example, one or more of these valves may be a check valve that allows refrigerant to flow through the valve when the refrigerant has reached a threshold pressure. As another example, one or more of these valves may be a solenoid valve that can be opened or closed by a control. Using a previous example, valve 135C may be a solenoid valve and valve 225C may be a check valve. In this example, during a defrost cycle, valve 135C opens to allow refrigerant to flow from low temperature compressor 130 to low temperature load 120A to defrost low temperature load 120A. The pressure of that refrigerant builds until it is high enough to pass through check valve 225C and flow to accumulator 210. When the defrost cycle ends, valve 135C is closed. In another example, both valves 135C and 225C are solenoid valves. During the defrost cycle, both valves 135C and 225C are opened to allow refrigerant to flow from low temperature compressor 130 through low temperature load 120A to defrost low temperature load 120A. When the defrost cycle ends, valves 135C and 225C are closed.

After the refrigerant defrosts a load, the refrigerant is directed to accumulator 210. Accumulator 210 separates that refrigerant into liquid portion 212 and vapor portion 214. Accumulator 210 then directs some of liquid portion 212 to ejector 205 and flash tank 110 and some of vapor portion 214 to medium temperature compressor 125. Ejector 205 directs liquid portion 212 to flash tank 110 for storage. Medium temperature compressor 125 compresses vapor portion 214. Because the pressure of the refrigerant at accumulator 210 is lower than the pressure of the refrigerant at flash tank 110, the pressure differential between low temperature compressor 130 and accumulator 210 is greater than the pressure differential between low temperature compressor 130 and flash tank 110. As a result, in certain embodiments, by directing the refrigerant used to defrost the loads to accumulator 210, the cost and size of piping used to carry that refrigerant is reduced compared to a system that directs the refrigerant directly to flash tank 110 after defrost. Additionally, in some embodiments, by directing the refrigerant used to defrost the loads to accumulator 210 the amount of refrigerant in the system and the size of flash tank 110 can be reduced without negatively impacting the efficiency of system 200.

In certain embodiments, a defrost cycle to defrost a medium temperature load 115 may be different from a defrost cycle to defrost a low temperature load 120. As a result, during a first defrost cycle, or a second mode of operation, a low temperature load 120 may be defrosted. Then, in a second defrost cycle, or a third mode of operation, a medium temperature load 115 may be defrosted.

FIG. 3 illustrates an example cooling system 300. As seen in FIG. 3, system 300 includes a high side heat exchanger 105, an ejector 205, a flash tank 110, medium temperature loads 115A and 115B, low temperature loads 120A and 120B, low temperature compressor 130, accumulator 210, medium temperature compressor 125, parallel compressor 215, oil separator 220, valves 135A, 135B, 135C, and 135D, and valves 225A, 225B, 225C, and 225D. Generally, accumulator 210 separates a refrigerant that was used to defrost a load into a liquid portion 212 and a vapor portion 214. Accumulator 210 then directs some of the liquid portion 212 to ejector 205 and flash tank 110 and some of the vapor portion 214 to medium temperature compressor 125. Because the pressure of the refrigerant at accumulator 210 is lower than the pressure of the refrigerant at flash tank 110, the pressure differential between low temperature compressor 130 and accumulator 210 is greater than the pressure differential between low temperature compressor 130 and flash tank 110. As a result, the size of the piping used to carry the refrigerant may be reduced when the refrigerant used to defrost the loads is directed to accumulator 210 instead of directly to flash tank 110 in certain embodiments.

High side heat exchanger 105, ejector 205, flash tank 110, medium temperature loads 115A and 115B, low temperature loads 120A and 120B, low temperature compressor 130, medium temperature compressor 125, accumulator 210, parallel compressor 215, oil separator 220, valves 135A, 135B, 135C and 135D, and valves 225A, 225B, 225C and 225D operate similarly as they did in system 200. For example, high side heat exchanger 105 removes heat from a refrigerant. Ejector 205 directs the refrigerant to flash tank 110. Flash tank 110 stores the refrigerant. Medium temperature loads 115A and 115B and low temperature loads 120A and 120B use the refrigerant from flash tank 110 to cool spaces proximate those loads. Low temperature compressor 130 compresses the refrigerant from low temperature loads 120A and 120B. Accumulator 210 separates refrigerant into liquid portion 212 and vapor portion 214. Accumulator 210 then directs some of liquid portion 212 to ejector 205 and flash tank 110 and some of vapor portion 214 to medium temperature compressor 125. Ejector 205 directs liquid portion 212 to flash tank 110 for storage. Medium temperature compressor 125 compresses vapor portion 214. Parallel compressor 215 compresses flash gas discharged from flash tank 110. Oil separator 220 separates oil from refrigerant received from parallel compressor 215 and medium temperature compressor 125.

An important difference between system 300 and system 200 is that medium temperature loads 115A and 115B are arranged in series in system 300, whereas these loads are arranged in parallel in system 200. In other words, in system 300, medium temperature load 115B uses refrigerant from flash tank 110 that has passed through medium temperature load 115A. After medium temperature load 115B uses that refrigerant from medium temperature load 115A to cool a space proximate medium temperature load 115B, medium temperature load 115B directs the refrigerant to accumulator 210. Likewise, medium temperature load 115A uses refrigerant directly from flash tank 110 to cool a space proximate medium temperature load 115A and then directs that refrigerant to medium temperature load 115B. As shown in FIG. 3, it is possible to use accumulator 210 to increase the pressure differential of the refrigerant even though medium temperature loads 115A and 115B are arranged in series as opposed to in parallel in system 200.

During a first mode of operation, or regular refrigeration cycle, medium temperature loads 115A and 115B and low temperature loads 120A and 120B use refrigerant to cool spaces proximate those loads. Low temperature loads 120A and 120B direct the refrigerant to low temperature compressor 130. Medium temperature load 115A directs refrigerant to medium temperature load 115B. Medium temperature load 115B directs the refrigerant to accumulator 210. Low temperature compressor 130 compresses the refrigerant from low temperature loads 120A and 120B and directs the refrigerant to medium temperature compressor 125. Accumulator 210 separates the refrigerant from medium temperature load 115B into a liquid portion 212 and vapor portion 214. Accumulator 210 then directs some of the liquid portion 212 to ejector 205 in flash tank 110 and some of vapor portion 214 to medium temperature compressor 125. Ejector 205 directs liquid portion 212 to flash tank 110 for storage. Medium temperature compressor 125 compresses vapor portion 214 and the refrigerant from low temperature compressor 130 and directs that refrigerant to oil separator 220.

During a second mode of operation, or defrost cycle, low temperature compressor 130 directs refrigerant back to a load to defrost the load. For example, during a low temperature defrost cycle, low temperature compressor 130 directs refrigerant back to low temperature load 120A. Valves 135C and 225C can open to allow refrigerant to flow from low temperature compressor 130 through low temperature load 120A to defrost low temperature load 120A. As another example, during a medium temperature defrost cycle, valves 135A and 225A can open to allow refrigerant to flow from low temperature compressor 130 through medium temperature load 115A to defrost medium temperature load 115A.

After the refrigerant defrosts the load, the refrigerant is directed to accumulator 210. Accumulator 210 separates the refrigerant into liquid portion 212 and vapor portion 214. Accumulator 210 then directs some of liquid portion 212 to ejector 205 and flash tank 110 and some of vapor portion 214 to medium temperature compressor 125. Ejector 205 directs liquid portion 212 to flash tank 110 for storage. Medium temperature compressor 125 compresses vapor portion 214. In this manner, the size and cost of piping used to carry the refrigerant is reduced compared to implementations where refrigerant used to defrost the loads flows directly to flash tank 110.

FIG. 4 is a flowchart illustrating a method 400 of operating an example cooling system. In certain embodiments, various components of system 200 or system 300 perform the steps of method 400. By performing method 400, the size and cost of piping used to carry refrigerant is reduced in certain embodiments.

In step 405, an ejector directs the refrigerant to a flash tank. The flash tank stores the refrigerant in step 410. In step 415, a first load uses the refrigerant to cool a first space. A second load uses the refrigerant to cool a second space in step 420. In step 425, a first compressor compresses the refrigerant from the first load. An accumulator separates the refrigerant from the second load into a first liquid portion and a first vapor portion in step 430. In step 435, the accumulator directs the first liquid portion to the ejector. The ejector directs the first liquid portion to the flash tank in steps 440. In step 445, the accumulator directs the first vapor portion to a second compressor. The second compressor compresses the first vapor portion in step 450.

During a first mode of operation, such as, for example, a regular refrigeration cycle, a third load uses the refrigerant to cool a third space in step 455. In step 460, the first compressor compresses the refrigerant from the third load. The second compressor compresses the refrigerant from the first compressor in step 465.

During a second mode of operation, such as, for example, a defrost cycle, the first compressor directs the refrigerant to the third load to defrost the third load in step 470. In step 475, the accumulator separates the refrigerant that defrosted the third load into a second liquid portion and a second vapor portion. The ejector directs the second liquid portion to the flash tank in step 480. In step 485, the second compressor compresses the second vapor portion.

Modifications, additions, or omissions may be made to method 400 depicted in FIG. 4. Method 400 may include more, fewer, or other steps. For example, steps may be performed in parallel or in any suitable order. While discussed as systems 200 and/or 300 (or components thereof) performing the steps, any suitable component of systems 200 and/or 300 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger) even though there may be other intervening components between the particular component and the destination of the refrigerant. For example, the flash tank receives a refrigerant from the accumulator even though there is an ejector between the flash tank and the accumulator.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

an ejector configured to direct a refrigerant to a flash tank configured to store the refrigerant;

a first load configured to use the refrigerant from the flash tank to cool a first space proximate the first load;

a second load configured to use the refrigerant from the flash tank to cool a second space proximate the second load;

a third load;

a first compressor configured to compress the refrigerant from the first load;

a second compressor; and an accumulator configured to:

separate the refrigerant from the second load into a first liquid portion and a first vapor portion;

direct the first liquid portion to the ejector, the ejector further configured to direct the first liquid portion to the flash tank; and direct the first vapor portion to the second compressor, the second compressor configured to compress the first vapor portion;

during a first mode of operation:

the third load configured to use the refrigerant from the flash tank to cool a third space proximate the third load;

the first compressor further configured to compress the refrigerant from the third load; and the second compressor further configured to compress the refrigerant from the first compressor; and during a second mode of operation:

the first compressor further configured to direct the refrigerant to the third load to defrost the third load;

the accumulator further configured to separate the refrigerant that defrosted the third load into a second liquid portion and a second vapor portion;

the ejector further configured to direct the second liquid portion to the flash tank; and the second compressor further configured to compress the second vapor portion.

2. The apparatus of claim 1, wherein, during the second mode of operation, the refrigerant that defrosted the third load passes through a solenoid valve before reaching the accumulator.

3. The apparatus of claim 1, further comprising a third compressor configured to compress a flash gas from the flash tank.

4. The apparatus of claim 1, further comprising a fourth load configured to use the refrigerant from the flash tank to cool a fourth space proximate the fourth load.

5. The apparatus of claim 4, wherein the second load is configured to use the refrigerant from the fourth load to cool the second space.

6. The apparatus of claim 1, wherein during a third mode of operation, the first compressor is further configured to direct the refrigerant to the second load to defrost the second load.

7. The apparatus of claim 1, further comprising a high side heat exchanger configured to remove heat from the refrigerant from the second compressor.

8. A method comprising:

directing, by an ejector, a refrigerant to a flash tank;

storing, by the flash tank, the refrigerant;

using, by a first load, the refrigerant from the flash tank to cool a first space proximate the first load;

using, by a second load, the refrigerant from the flash tank to cool a second space proximate the second load;

compressing, by a first compressor, the refrigerant from the first load;

separating, by an accumulator, the refrigerant from the second load into a first liquid portion and a first vapor portion;

directing, by the accumulator, the first liquid portion to the ejector;

directing, by the ejector, the first liquid portion to the flash tank;

directing, by the accumulator, the first vapor portion to a second compressor;

compressing, by the second compressor, the first vapor portion;

during a first mode of operation:

using, by a third load, the refrigerant from the flash tank to cool a third space proximate the third load;

compressing, by the first compressor, the refrigerant from the third load; and compressing, by the second compressor, the refrigerant from the first compressor; and during a second mode of operation:

directing, by the first compressor, the refrigerant to the third load to defrost the third load;

separating, by the accumulator, the refrigerant that defrosted the third load into a second liquid portion and a second vapor portion;

directing, by the ejector, the second liquid portion to the flash tank; and compressing, by the second compressor, the second vapor portion.

9. The method of claim 8, wherein, during the second mode of operation, the refrigerant that defrosted the third load passes through a solenoid valve before reaching the accumulator.

10. The method of claim 8, further comprising compressing, by a third compressor, a flash gas from the flash tank.

11. The method of claim 8, further comprising using, by a fourth load, the refrigerant from the flash tank to cool a fourth space proximate the fourth load.

12. The method of claim 11, further comprising using, by the second load, the refrigerant from the fourth load to cool the second space.

13. The method of claim 8, further comprising directing, by the first compressor, the refrigerant to the second load to defrost the second load during a third mode of operation.

14. The method of claim 8, further comprising removing, by a high side heat exchanger, heat from the refrigerant from the second compressor.

15. A system comprising:

a high side heat exchanger configured to remove heat from a refrigerant;

an ejector configured to direct the refrigerant from the high side heat exchanger to a flash tank configured to store the refrigerant;

a first load configured to use the refrigerant from the flash tank to cool a first space proximate the first load;

a second load configured to use the refrigerant from the flash tank to cool a second space proximate the second load;

a third load;

a first compressor configured to compress the refrigerant from the first load;

a second compressor; and an accumulator configured to:

separate the refrigerant from the second load into a first liquid portion and a first vapor portion;

direct the first liquid portion to the ejector, the ejector further configured to direct the first liquid portion to the flash tank; and direct the first vapor portion to the second compressor, the second compressor configured to compress the first vapor portion;

during a first mode of operation:

the third load configured to use the refrigerant from the flash tank to cool a third space proximate the third load;

the first compressor further configured to compress the refrigerant from the third load; and the second compressor further configured to compress the refrigerant from the first compressor; and during a second mode of operation:

the first compressor further configured to direct the refrigerant to the third load to defrost the third load;

the accumulator further configured to separate the refrigerant that defrosted the third load into a second liquid portion and a second vapor portion;

the ejector further configured to direct the second liquid portion to the flash tank; and the second compressor further configured to compress the second vapor portion.

16. The system of claim 15, wherein, during the second mode of operation, the refrigerant that defrosted the third load passes through a solenoid valve before reaching the accumulator.

17. The system of claim 15, further comprising a third compressor configured to compress a flash gas from the flash tank.

18. The system of claim 15, further comprising a fourth load configured to use the refrigerant from the flash tank to cool a fourth space proximate the fourth load.

19. The system of claim 18, wherein the second load is configured to use the refrigerant from the fourth load to cool the second space.

20. The system of claim 15, wherein during a third mode of operation, the first compressor is further configured to direct the refrigerant to the second load to defrost the second load.

* * * * *